US006404305B1

(12) United States Patent
Block

(10) Patent No.: US 6,404,305 B1
(45) Date of Patent: Jun. 11, 2002

(54) STRIP TRANSMISSION FILTER

(75) Inventor: Christian Block, Stainz (AT)

(73) Assignee: Epcos Aktiengesellschaft, Munich (DE)

( * ) Notice: Subject to any disclaimer, the term of this patent is extended or adjusted under 35 U.S.C. 154(b) by 0 days.

(21) Appl. No.: 09/509,620

(22) PCT Filed: Sep. 24, 1998

(86) PCT No.: PCT/DE98/02858

§ 371 (c)(1),
(2), (4) Date: Mar. 29, 2000

(87) PCT Pub. No.: WO99/17393

PCT Pub. Date: Apr. 8, 1999

(30) Foreign Application Priority Data

Sep. 29, 1997 (DE) ..... 197 42 971

(51) Int. Cl.[7] ..... H01P 1/203
(52) U.S. Cl. ..... 333/204; 333/219
(58) Field of Search ..... 333/204, 202, 333/205, 219, 222, 206

(56) References Cited

U.S. PATENT DOCUMENTS 5,045,824 A * 9/1991 Metroka ..... 333/206
5,144,269 A * 9/1992 Itoh ..... 333/204
5,177,458 A * 1/1993 Newell et al. ..... 333/206
5,208,565 A * 5/1993 Sogo et al. ..... 333/206
5,248,949 A 9/1993 Eguchi et al. ..... 333/204
5,612,654 A * 3/1997 Tsujiguchi et al. ..... 333/202
5,949,310 A * 9/1999 Matsumoto et al. ..... 333/202
6,087,910 A * 7/2000 Matsumoto et al. ..... 333/202

FOREIGN PATENT DOCUMENTS

EP 0 438 149 A2 7/1991

* cited by examiner

*Primary Examiner*—Robert Pascal
*Assistant Examiner*—Stephen E. Jones
(74) *Attorney, Agent, or Firm*—Schiff Hardin & Waite

(57) ABSTRACT

A strip transmission filter having resonators with impedance skips in which the resonators are provided in a ceramic substrate. The strip transmission filter also includes capacitive couplings. The ceramic substrate has a metallic coating on all sides except for a face side. The coupling structures are at the face side of the substrate. The ceramic substrate is constructed in a stepped formation in a region of the coupling structures and at least one ground terminal. Thus, the adhesion of metallic coating is increased which, in turn, facilitates soldering.

2 Claims, 2 Drawing Sheets

STRIP TRANSMISSION FILTER

BACKGROUND OF THE INVENTION

1. Field of the Invention

The invention relates to a strip transmission filter with resonators that are provided in a ceramic substrate. In particular, the invention relates to a strip transmission filter having capacitive coupling structures for coupling an HF signal in and out, and in which the ceramic substrate has a metallic coating on all sides with the exception of the face side, which has the coupling structures.

DESCRIPTION OF RELATED ART

Known strip transmission filters typically have a capacitive coupling of the resonators. On the base surface of a ceramic substrate, one surface is separated from the surrounding mass galvanically, so that this surface forms a capacitance with repsect to a track that is arranged above on the ceramic substrate and is separated by the dielectric.

The capacitance is dependent on the dielectric constant $\epsilon$ of the dielectric, the thickness of the substrate, and the size of the surface.

European Document No. 718 906 A1 teaches a ceramic substrate having two strip transmission line resonators arranged on its top surface. By a galvanic separating of the all over ground metallization, metal surfaces for coupling are created on the bottom side of the substrate. On the top side of the ceramic substrate with the stripline resonators, metallic surfaces are arranged, which are contacted to the metallic surfaces for coupling with the aid of through holes which are metallized on the inside.

The coupling of the strip transmission filter is accomplished by contacting the metallic coupling surfaces, which are galvanically separated from the surrounding ground metallization by the separating surfaces, through to the other side of the ceramic substrate. Thus, the capacitive coupling with the strip transmission resonators on the opposite side is achieved.

The coupling is determined mainly by the spacing of the coupling structures, and not by the thickness of the substrate, which preferably consists of a highly dielectric microwave ceramic. Thus, the coupling structure can be produced mechanically or by etching with significantly higher tolerances. Furthermore, the coupling can also be created by etching, whereby the position of the mask of photosensitive resist is not critical to the coupling capacity.

A disadvantage of the above strip transmission filter is that, it can be produced only at a relatively great expense. Another disadvantage is that the dimensions of the component are also increased due to the measure of through-contacting that is taken in order to connect the metallic surfaces that are provided on both surfaces of the strip transmission filter to each other.

Furthermore, the pass characteristic of microwave ceramic filters should have an optimally high edge steepness in order to suppress LO oscillator frequencies, image frequencies, etc. At the same time, however, the pole number—that is, the number of inner conductors—should be optimally small in order to obtain an optimally low insertion loss (which will be detailed later), since this rises with the number of poles.

Microwave ceramic filters were used for this, in which the coupling structures are arranged in the region of the outer edges, and a one-sided steepening of the filter curve edges was achieved by impedance skips of $\lambda/4$ resonators that are to be coupled to one another.

SUMMARY OF THE INVENTION

It is the an object of the present invention to produce a strip transmission filter which comprises a better adhesion of the metallic coating on the ceramic substrate. A further object is to be able to adapt the bandwidth of the filter to the respective applications without notable outlay.

In an embodiment, the present invention provides a strip transmission filter having a ceramic substrate having a face side. A metallic coating is on the ceramic substrate, but not on the face side of the substrate. Resonators are provided in the ceramic substrate, the resonators each have an impedance skip. Capacitive couplings are on the face side and provide a HF signal in and out of the strip transmission filter. At least one ground terminal is on the face side. The ceramic structure is stepped in a region of the capacitive couplings and the at least one ground terminal.

In an embodiment, the strip transmission filter includes a step depth of the at least one ground terminal that can be adjusted for the purpose of changing a bandwidth of the filter.

In an embodiment, the strip transmission filter has an edge steepness that provides a filter curve, F. The filter curve, F, is adjustable by changing a spacing, A, between the capacitive couplings and a size of each of the capacitive couplings.

According to a preferred embodiment of the invention, a gradation is realized in the ceramic substrate in which the strip transmission resonators of the strip transmission filter are arranged, said step being realized in the region of the capacitively acting coupling structures and in the region of at least one ground terminal.

Such an inventively provided step in the region of the coupling structures increases the adhesion of the metallic coating, and allows for more effective soldering of microwave lines that are to be connected through this.

According to an advantageous development of the invention, the depth of the step—that is, the dimension of the step in the direction of the longitudinal extent of the striplines—of a ground terminal that is provided in the region of the coupling structures can be adjusted. This makes it possible to correct the bandwidth of the pass characteristic of the strip transmission filter in a simple but effective manner.

Furthermore, according to another advantageous development of the invention, the edge steepness of the filter curve can be correspondingly adjusted in view of the respective application by varying the distance between the coupling structures and/or varying the size of the coupling structures.

In practice, this means that when the spacing between the coupling structures is small and the coupling itself is selected to be weak (for instance, by constructing the coupling structures very narrow), the edge steepness of a strip transmission filter of such a construction is significantly increased due to an overcoupling between the coupling structures.

The invention is detailed below with reference to the enclosed drawings.

DETAILED DESCRIPTION OF THE PRESENTLY PREFERRED EMBODIMENTS

Figure 1:
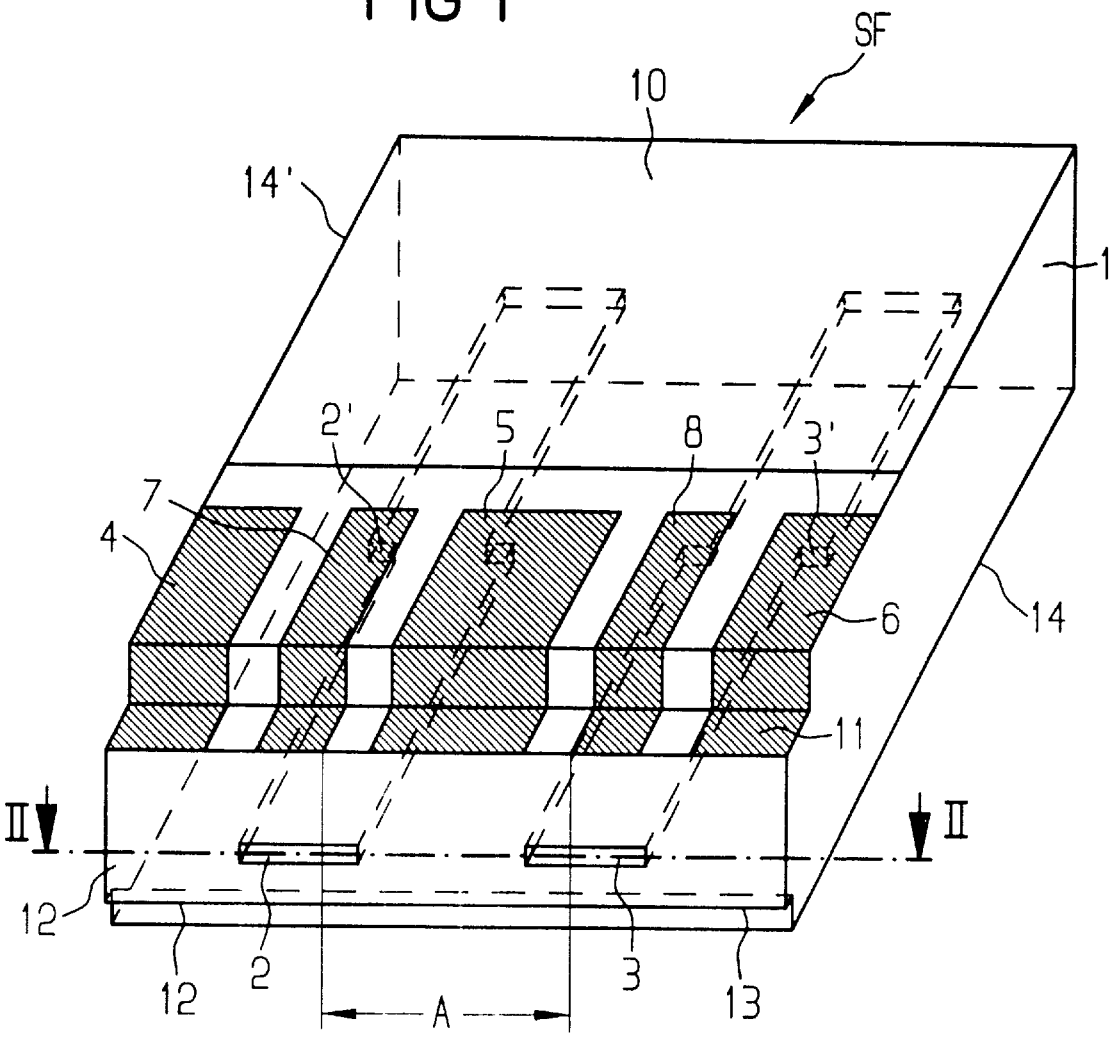
FIG. 1 is an enlarged schematic perspective view of a preferred embodiment of an inventive strip transmission filter.

In FIG. 1, a strip transmission filter, referenced SF as a unit, has a ceramic substrate 1, in which two strip transmission resonators 2 and 3 are provided, whose course inside the substrate 1 in FIG. 1 is merely indicated by broken lines. The course of the strip transmission lines can be derived more exactly from the sectional view in FIG. 2, which will be discussed later.

On a top side 10 of the ceramic substrate 1 and on the side of the front face 12 are coupling structures 7 and 8. Between and outside the coupling structures 7 and 8 are ground terminals 4 to 6 which are produced by galvanic separation of the metallized surface 10, for instance, mechanically, by etching, or with photosensitive resist.

Apart from the coupling surfaces 7 and 8 and the front face 12, the ceramic body 10 is metallized on all sides. That is, even the surface opposite the front face 12, in which the two strip transmission lines 2 and 3 end, is metallized.

As shown in FIG. 1, the two coupling structures 7 and 8 and the ground terminal surfaces 4 to 6 comprise a gradation 11. Furthermore, a smaller step 13, which recedes even further back, is constructed along the lower longitudinal edge 12' of the front face 12.

As already mentioned, the two steps 11 and 13 improve the adhesion of the metallic coating, particularly in the region of the face side 12 and in the region of the transitions from the top side 10 to the face side 12, or respectively, from the face side 12 to the bottom side of the substrate 1. The construction of steps also facilitates the soldering of lines quite appreciably.

Figure 2:
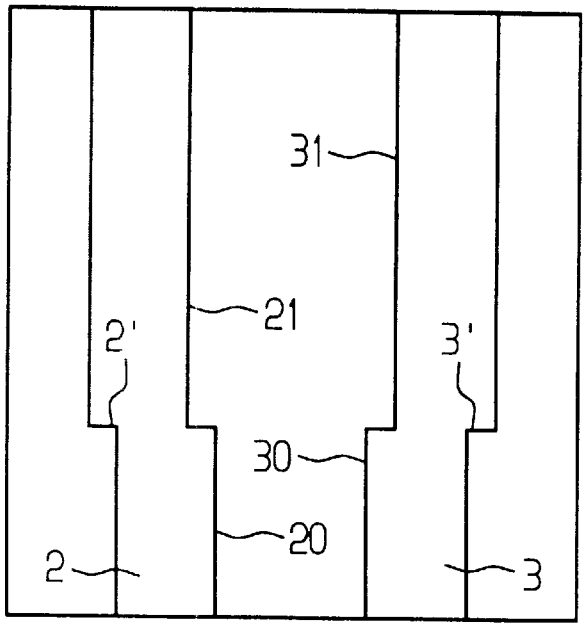
FIG. 2 is a sectional view along a line II—II in FIG. 1.

FIG. 2 shows a sectional view of the embodiment in FIG. 1. In FIG. 2, the two strip transmission lines 2, 3 include line discontinuities 2', or respectively, 3', which create the inventively provided impedance skips on the basis of surge impedance skips.

The line discontinuities 2' and 3' in FIG. 2 are such that the spacing between the inner longitudinal edges 20 and 30 of the strip transmission lines 2, or 3, respectively, in the region of the coupling structures 7 and 8 is smaller than the spacing between the corresponding longitudinal edges 21 and 31 in the rear part of the substrate 1, or respectively, in the upper part of the sectional illustration of FIG. 2.

In general, it is possible to influence the edge steepness of a strip transmission filter by means of the line discontinuities 2' and 3' represented in FIG. 2, by displacing the sections of the strip transmission lines 2 and 3 situated inside the substrate 1 relative to the left and right side surfaces 14 or 14'. In the inventive strip transmission filter SF, the front edge of the pass characteristic can be additionally steepened by reducing the spacing A between the two coupling structures 7 and 8 (see FIG. 1) and/or additionally selecting a weak type of coupling; that is, by realizing the two coupling structures 7 and 8 so as to be very narrow, for example.

Figure 3:
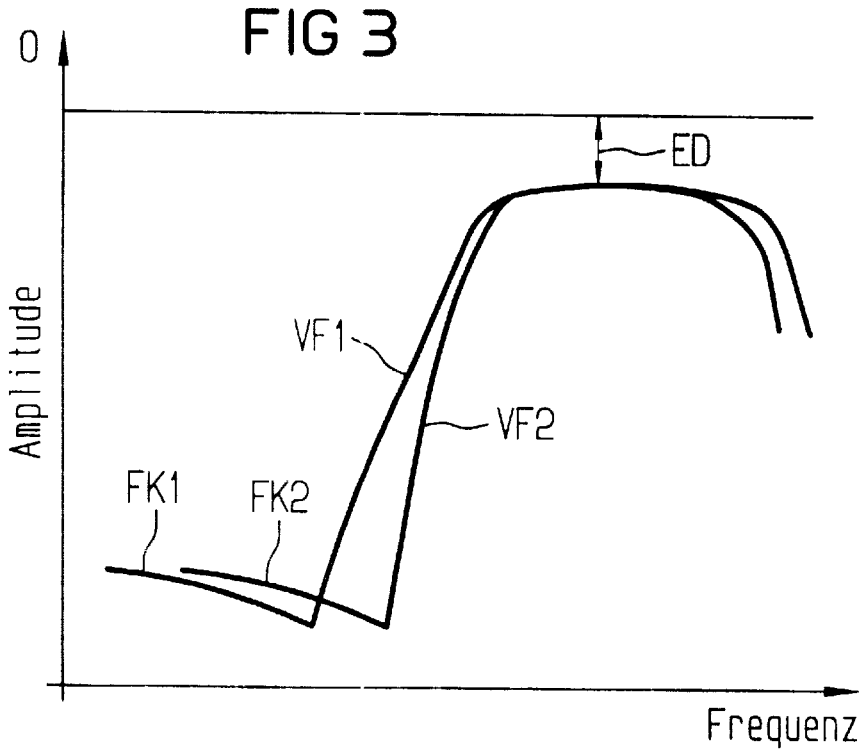
FIG. 3 is a graph representing the inventively achievable steepening of a filter curve's front edge according to the present invention.

On the basis of the overcoupling between the coupling structures 7 and 8 which this creates, the steepness can be increased appreciably, as is illustrated by the graphs in FIG. 3. In FIG. 3, the frequency is plotted on the abscissa, and the amplitude is plotted on the vertical axis.

By reducing the spacing A between the coupling structures 7 and 8 and/or by designing very narrow coupling structures, in a strip transmission filter the front edge VF2 of its pass curve FK2 can be inventively steepened appreciably compared to the front edge VF1 of the filter curve FK1 of a strip transmission filter in which the above described inventive measures have not been taken.

In the diagram of FIG. 3, the signal curve is plotted in the form of amplitude as a function of frequency. Relative to a damping 0, which is indicated in FIG. 3 by a horizontal reference line, the payload signal through the strip transmission filter SF experiences a definite unavoidable damping, which is a matter of the above mentioned insertion loss. This insertion loss, referenced ED in FIG. 3, is not impaired, particularly not worsened, by the steepening of the front edge VF2 of the pass curve FK2.

It should be understood that various changes and modifications to the presently preferred embodiments described herein will be apparent to those skilled in the art. Such changes and modifications can be made without departing from the spirit and scope of the present invention without diminishing its attended advantages. It is, therefore, intended that such changes and modifications be covered by the appended claims.

I claim:

1. A strip transmission filter, comprising:

a ceramic substrate having a face side;

a metallic coating on the ceramic substrate, but not on the face side;

at least two resonators being provided in the ceramic substrate, the at least two resonators each having an impedance skip;

at least two capacitive couplings on the face side, the at least two capacitive couplings provides a HF signal in and out of the strip transmission filter;

at least one ground terminal on the face side; and the ceramic structure being stepped in a region of the at least two couplings and the at least one ground;

said at least one ground terminal having a step with a step depth to set a bandwidth of said filter.

2. A strip transmission filter according to claim 1, wherein said capacitive couplings each has a size and wherein said capacitive couplings having a spacing therebetween, and wherein said filter has a filter curve that is set by a selection of said sizes of said capacitive couplings and said spacing between said capacitive couplings.

* * * * *